US010273060B2

(12) United States Patent
Antier et al.

(10) Patent No.: US 10,273,060 B2
(45) Date of Patent: Apr. 30, 2019

(54) PACKAGING SYSTEM AND USE THEREOF

(71) Applicant: SOCIETE LORRAINE DE CAPSULES METALLIQUES—MANUFACTURE DE BOUCHAGE (SOLOCAP-MAB), Contrexeville (FR)

(72) Inventors: Grégory Antier, Trevoux (FR); Andrew Stone, Northbrook, IL (US)

(73) Assignee: SOCIETE LORRAINE DE CAPSULES METALLIQUES-MANUFACTURE DE BOUCHAGE (SOLOCAP-MAB), Contrexville (FR)

( * ) Notice: Subject to any disclaimer, the term of this patent is extended or adjusted under 35 U.S.C. 154(b) by 592 days.

(21) Appl. No.: 14/351,944

(22) PCT Filed: Oct. 24, 2012

(86) PCT No.: PCT/EP2012/070993
§ 371 (c)(1),
(2) Date: Apr. 15, 2014

(87) PCT Pub. No.: WO2013/060694
PCT Pub. Date: May 2, 2013

(65) Prior Publication Data

US 2014/0231376 A1 Aug. 21, 2014

(30) Foreign Application Priority Data

Oct. 25, 2011 (FR) ..... 11 59656

(51) Int. Cl.
*B65D 41/00* (2006.01)
*B65D 41/04* (2006.01)
(Continued)

(52) U.S. Cl.
CPC ..... *B65D 41/04* (2013.01); *B65B 7/2835* (2013.01); *B65D 41/0471* (2013.01); *B65D 51/24* (2013.01)

(58) Field of Classification Search
CPC ..... B65D 41/04; B65D 51/24; B65D 7/2835; B65D 41/0471
(Continued)

(56) References Cited

U.S. PATENT DOCUMENTS 4,071,156 A * 1/1978 Lowe ..... B65D 41/48 215/206
4,417,666 A * 11/1983 Roberts ..... B65D 41/3442 215/256
(Continued)

FOREIGN PATENT DOCUMENTS

DE 9317231 2/1994
GB 2339771 2/2000

*Primary Examiner* — Ernesto Grano
(74) *Attorney, Agent, or Firm* — Duane Morris LLP; J. Rodman Steele, Jr.; Gregory M. Lefkowitz

(57) ABSTRACT

The packaging system according to the invention comprises a container (1), which includes a neck (2) defining an axis (X-X), and a stopper (10) for closing the neck, which includes a skirt (12) adapted to be fastened removably around the neck. In order to quickly and easily check that the stopper is positioned correctly on the neck when the container is closed, the invention provides means for visually checking that the system is in a closed configuration, predetermined afterwards by applying a preset stress for having the skirt cooperate with the neck, said means comprise both:

first indicators (20, 22) of the angular position around the axis between the neck and the skirt, said first indicators being respectively borne by the neck and the skirt and being designed to be arranged with an angular spacing between them which is substantially equal to a first predetermined value when the packaging system is in the closed configuration, and (Continued)

second indicators (21, 23) of the position along the axis between the skirt and the neck, said second indicators being separate from the first indicators, borne respectively by the neck and by the skirt, and designed to be arranged parallel to each other with an axial spacing (Δ) between them which is below a second predetermined value when the packaging system is in the closed configuration.

19 Claims, 3 Drawing Sheets

(51) Int. Cl.
*B65B 7/28* (2006.01)
*B65D 51/24* (2006.01)

(58) Field of Classification Search
USPC ..... 215/44
See application file for complete search history.

(56) References Cited

U.S. PATENT DOCUMENTS 4,449,639 A * 5/1984 Davis ..... B65D 41/485 215/224
4,511,051 A * 4/1985 Desai ..... B65D 41/48 215/225
4,524,876 A * 6/1985 Kusz ..... B65D 50/061 215/223
4,531,650 A * 7/1985 Friendship ..... B65D 41/48 215/256
4,573,599 A * 3/1986 Fillmore ..... B65D 41/48 215/225
4,790,448 A * 12/1988 Ostrum ..... B65D 43/0256 215/256
4,909,404 A * 3/1990 Rozenberg ..... B29C 45/2618 215/200
4,919,286 A * 4/1990 Agbay, Sr. ..... B65D 41/48 215/235
5,207,783 A * 5/1993 Burton ..... B65D 41/3442 215/235
5,292,019 A * 3/1994 Patterson ..... B65D 41/3404 215/254
5,395,003 A * 3/1995 Matsuda ..... B65D 43/026 215/256
5,398,829 A * 3/1995 Stubbs ..... B65D 41/485 215/201
5,423,441 A * 6/1995 Conti ..... B65D 50/061 215/225
6,405,885 B1 * 6/2002 Elliott ..... B65D 47/0838 215/237
6,431,380 B1 * 8/2002 Branson ..... B65D 50/062 215/206
6,631,820 B2 * 10/2003 Harrold ..... B65D 47/0809 215/230
6,758,358 B1 * 7/2004 Bloom ..... B65D 50/061 215/206
6,763,960 B2 * 7/2004 Oh ..... B65D 43/021 215/201
6,766,917 B1 * 7/2004 Blewitt, III ..... B65D 41/3423 215/252
D686,042 S * 7/2013 Del Solar ..... D7/629
D686,043 S * 7/2013 Del Solar ..... D7/629
D686,044 S * 7/2013 Del Solar ..... D7/629
8,746,486 B2 * 6/2014 Del Solar ..... B65D 51/00 215/230
8,794,460 B2 * 8/2014 Druitt ..... B65D 47/0809 215/235
9,016,489 B2 * 4/2015 McFarlane ..... B65D 1/0246 215/217
9,211,967 B2 * 12/2015 Ungrady ..... B65D 1/023
2009/0242562 A1 * 10/2009 Valderrama ..... B65D 43/0231 220/288

* cited by examiner

PACKAGING SYSTEM AND USE THEREOF

CROSS-REFERNCE TO RELATED APPLICATIONS

This application is a § 371 national stage entry of International Application No. PCT/EP2012/070993, filed Oct. 24, 2012, which claims priority to French Patent Application No. 1159656 filed Oct. 25, 2011, the entire contents of which are incorporated herein by reference.

The present invention relates to a packaging system and to a use of such a system. The invention in particular relates to packaging systems for liquid foods, but is more generally applicable to all systems for packaging a product, food or otherwise, that comprise a container for storing the product and a removable stopper for closing the neck of the container.

On automated bottling lines, stoppers are put in place on the necks of bottles, to cover the latter, using ad hoc machines that drive the stoppers according to predetermined kinematics. Thus, in the case of screw stoppers, i.e. stoppers designed to be screwed on a complementary thread surrounding an end ring of the neck of the bottle, the aforementioned machines screw the stoppers with a predetermined tightening torque. In principle, this placement means that the stopper reaches a predetermined final position around the neck, in which it hermetically seals the neck. That being said, in practice, this placement of the stopper may be hindered for various reasons, which may be related to a quality defect of the end ring of the neck, or which may be related to resistance, or even jamming of the stopper at an intermediate height of the ring, due to greater-than-expected interference between the tamperproofing means, inside the stopper, and an associated raised portion, provided on the outer surface of the neck of the bottle, or which may be related to poor placement of a sealing element, such as a disc, in the bottom of the stopper. Whatever the reason, the result is that the stopper does not, at the end of the action of the bottling machine mentioned above, reach the expected position on the neck. In other words, the neck of the container is then improperly closed.

In order to circumvent this difficulty, are packaging systems exist which are not to be mistaken with the type of packaging systems coming under the invention and in which the screwing of the stopper on the neck is continued until the stopper occupies a predetermined angular position, generally located by elements respectively borne by the stopper and the neck. In this case, it is understood that the problem is different in the sense that a preset tightening torque is not applied, to the benefit of more or less strong tightening, the value of which is adjusted so as to control the final relative positioning of the stopper on the neck. Such a solution requires specific arrangements, such as flexible threads like in GB-A-2,339,771, and is incompatible with high bottling rates.

The aim of the present invention is to propose a packaging system making it possible to easily and quickly verify the proper positioning of the stopper on the neck of a container after the container is closed.

To that end, the invention relates to a packaging system, as defined in claim 1.

One of the ideas of the base of the invention is to seek to visually check the relative position of the stopper and the container neck once the packaging system is meant to be in its closed configuration sealing the neck using the stopper. To that end, the invention provides two pairs of indicators, which make it possible respectively to check the angular position and the axial position between the stopper and the neck. The pair used to verify the angular position includes indicators, which are respectively borne by the neck and the skirt of the stopper and which are designed to be angularly distant from each other by a spacing which is smaller than (substantially equal to) a first predetermined value, potentially equal to 0, when the packaging system is in the closed configuration, which, in the case of a screw stopper, means that, after applying the preset tightening torque, the stopper has been suitably rotated to screw the latter around the neck, in other words over a suitable tightening path. The pair used to verify the position along the axis includes other indicators, which are respectively borne by the neck and the skirt and which are designed to be parallel to each other, while being axially remote from each other by a spacing smaller than a second predetermined value, which means that the stopper has been engaged enough around the neck in the direction opposite the free end of that neck, thereby guaranteeing effective sealing of the free end, for example by axial crushing of the sealing disc provided in the bottom of the stopper. In practice, the two checks, respectively associated with the two pairs of indicators, are done visually, by observing directly from outside the packaging system, that observation be able to be done either by a posted operator, or by image acquisition and processing means, such as a camera. Of course, if either of the two pairs of indicators is not in its expected configuration, this means that the placement of the stopper is not completely correct, with a risk of leakage. The packaging system can then be rejected or, more generally, moved away from the rest of the packaging devices whereof the closing configuration has been positively verified. According to the invention, the different indicators belonging to the visual check means for the closed configuration of the packaging system can assume various embodiments, in particular resulting from how those indicators are made, as outlined below based on example embodiments. In any case, these indicators allow a particularly fast and effective check, in particular suitable for the operating rhythms of automated bottling lines.

Additional advantageous features of this packaging system according to the invention, considered alone or according to all technically possible combinations, are specified in the dependent claims.

The object of the invention is also a use of a packaging system as defined in claim 15.

The invention will be better understood upon reading the following description, provided solely as an example and done in reference to the drawings, in which.

Figure 3:
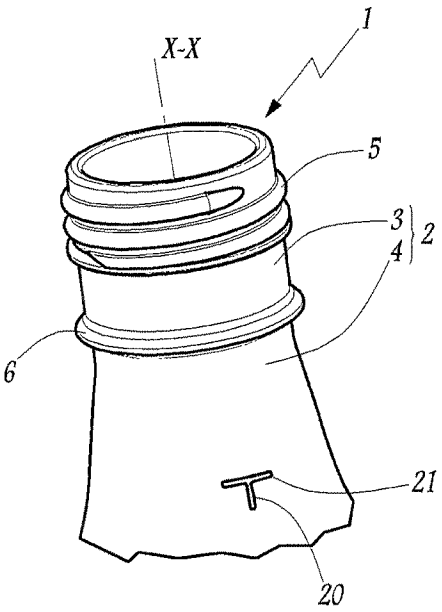
FIG. 3 is a view similar to FIG. 2, showing only part of the container belonging to the packaging system.
Figure 2:
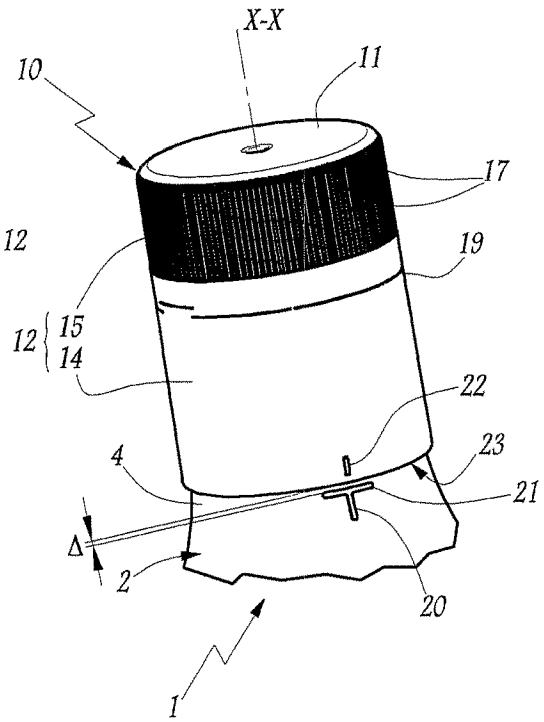
FIG. 2 is a perspective view of the packaging system of FIG. 1.
Figure 1:
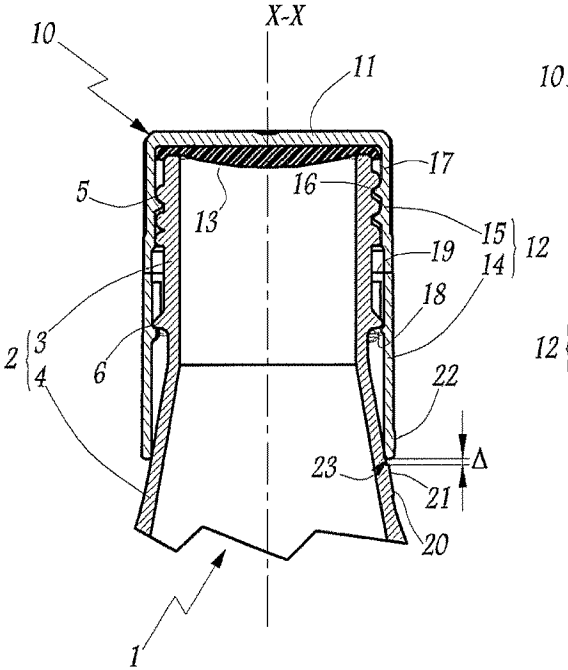
FIG. 1 is a longitudinal cross-section of a packaging system according to the invention, shown in a closed configuration.

FIGS. 1 to 3 show a packaging system, comprising a container 1, such as a bottle, only partially shown, and a stopper 10 adapted to be attached and removably fastened on a neck 2 of the container 1 so as to plug that neck.

In practice, the neck 2 is either integral with the rest of the container 1, in particular when the latter is a glass or plastic bottle, or adapted to be permanently secured on a wall of the container, at an opening passing through that wall.

As described in detail below, the neck 2 has a globally tubular shape, the central longitudinal axis of which is referenced X-X. Likewise, the stopper 10 has a globally tubular shape, the central longitudinal axis of which is combined with the axis X-X when the stopper 10 seals the neck 2.

For convenience, the rest of the description of the packaging system is oriented in relation to the axis X-X, considering that the terms "lower" and "bottom" describe a direction along axis X-X, going from the neck 2 toward the rest of the container 1. Conversely, the terms "upper" and "top" correspond to an opposite axial direction. Likewise, the term "inner" describes a direction oriented transversely toward the axis X-X, while the term "outer" corresponds to an opposite transverse direction.

As shown in FIGS. 1 and 3, the upper end of the neck 2 has a globally cylindrical ring 3 with a circular base, centered on the axis X-X. The upper end of the ring 3 is free, while being open to the outside, thereby making it possible to pour the product contained in the container when the stopper 10 is absent. At its opposite axial end, the ring 3 is connected to the main body, not shown, of the container 1 by a base 4 of the neck, which, in the embodiment considered in the figures, flares gradually downward. The outer surface of the ring 3 is provided, successively from top to bottom, with a helical thread 5 and a heel 6, which both extend protruding outwardly.

As indicated above, the stopper 10 has a globally tubular shape, centered on the axis X-X when that stopper seals the neck. As shown in FIGS. 1 and 2, the stopper 10 is open at its lower end and is closed at its upper end by a bottom wall 11 which, in the embodiment considered here, is globally planar, having a discoid shape centered on the axis X-X. An outer tubular skirt 12 centered on the axis X-X extends downward from the outer peripheral part of the bottom wall 11. Inside that skirt 12, the lower surface of the bottom wall 11 is covered by a sealing disc 13. When the stopper 10 seals the neck 2, in other words when the packaging system is in the closed configuration illustrated by FIGS. 1 and 2, the skirt 12 surrounds the outer surface of the neck 2, as outlined below, and the bottom wall 11 is arranged through the opening on the outside of the neck 2, with axial insertion of the outer peripheral part of the disc 13 between the bottom wall 11 and the upper axial end of the ring 3.

In the embodiment considered here, the skirt 12 includes two tubular axial parts, centered on the axis X-X and successively in the direction of the axis X-X, i.e. a lower skirt portion 14, described a bit later, and an upper skirt portion 15, which connects the lower portion 14 to the bottom wall 11.

As shown in FIG. 1, the inner surface of the upper skirt portion 15 is provided with a thread 16 radially protruding inward and complementary to the outer thread 5 of the ring 3 of the neck 2, thereby allowing the stopper 10 to be screwed around and unscrewed from the neck. It will be noted that the cooperation by screwing between the threads 5 and 16 is rigid, in the sense that these threads have sufficient respective rigidities so that their engagement imposes that the stopper 10 follows a helicoidal trajectory relatively to the neck 2. In this context, it is understood that in the case of a non-perturbed cooperation between the threads 5 and 16, by applying a preset tightening torque to the stopper 10, it is possible to screw it on so as to have the system 1 pass from an open configuration, in which the neck is open, the stopper being sufficiently distant from the neck so as to allow free passage of liquid through the neck, to a closed configuration in which the stopper occupies on the neck a predetermined final position such that it hermetically seals off the neck. In practice, it is understood that in the case when the ring 3 and the skirt 12 have several respective threads, for example two or three threads which are engaged upon screwing the skirt around the neck, as many predetermined final positions of the stopper on the neck may be attained in the closed configuration. Moreover, embodiments other than the mating threads 5 and 16, may be contemplated for the respective means of the skirt and of the neck, allowing removable attachment of the skirt around the neck and the passing of the packaging system 1 from its open configuration to its closed configuration, by applying a preset stress for having these means cooperate with each other.

To facilitate the grasping and rotation of the skirt portion 15, the outer surface of that skirt portion is advantageously provided with radially protruding ribs 17 which, as shown in FIG. 2, each extend lengthwise parallel to the axis X-X and which are distributed substantially uniformly on the outer periphery of the skirt portion 15.

As shown in FIG. 1, the inner surface of the lower skirt portion 14 is provided with a raised portion 18, which protrudes radially inward and is adapted to abut axially upward against the outer heel 6 of the neck 2 when the stopper 10 is opened for the first time, so as to axially retain the skirt portion 14 around the neck 2, subject to the breaking of a peripheral weakening line 19 initially connecting the lower axial end of the upper skirt portion 15 and the upper axial end of the lower skirt portion 14 to each other. In practice, the aforementioned raised portion 18 can, for example, assume the form of a band running over the entire inner periphery of the skirt portion 14, or assume the form of a series of palettes, distinct from each other and distributed along that inner periphery. Likewise, the aforementioned weakening line 19 can assume various forms, not limiting on the present invention, for example including a series of frangible bridges, which are distributed along the periphery of the skirt 12 and which are obtained either by molding or by cutting the wall of that skirt. In any case, when, while the packaging system is in its closed configuration, the upper skirt portion 15 is unscrewed for the first time from the ring 3 of the neck 2, the weakening line 19 breaks, thereby allowing, by complete unscrewing, the release of the upper skirt portion 15, as well as of the bottom wall 11 and the sealing disc 13, with regard to the neck 2 to open that neck on the outside of the container 1, whereas, at the same time, the lower skirt portion 14 is retained around the neck 2, by cooperation between its raised portion 18 and the heel 6 of the neck. The packaging system then goes into an open configuration, not shown in the figures, in which the stopper 10 no longer seals the neck 2.

It will be noted that, in the example embodiment considered in the figures, the lower skirt portion 14 extends axially downward well beyond the raised portion 18, in particular such that, in the closed configuration of the packaging system, its lower end is in the immediate vicinity of, or even slightly interferes with the base 4 of the neck 2, as shown in FIG. 1. As a result, for this embodiment, when the weakening line 19 is broken, the lower skirt portion 14 remains practically, or even completely immobile in the direction of the axis X-X, the burden of its weight then being borne by the base 4 of the neck 2, by axial downward bearing of the lower end of that skirt portion 14 against that base 4. As one alternative not shown, the lower skirt portion 14 can be less axially extended downward, or even broken just below the raised portion 18, then initially only covering the upper end portion of the base 4, or not covering that base 4 at all. In that case, in a known manner, the outer surface of the base 4 of the neck 2 is advantageously provided with a flange radially protruding outward, against which the skirt portion 14 bears axially after having axially descended along the ring 3, following the break of the weakening line 19.

According to the invention and as shown in FIG. 3, the neck 2 of the container 1 securely bears two indicators 20 and 21, respectively in the form of an elongate rib that extends in the direction of the axis X-X, and in the form of an elongate rib that extends in a direction orthoradial to the axis X-X. In the embodiment considered here, the indicators 20 and 21 are adjacent: more specifically, the indicator 20 extends downward from the middle of the indicator 21, thereby giving these indicators 20 and 21 a T-shaped profile when considered jointly, with the vertical line of the «T» extending parallel to the X-X axis, while the horizontal line of the « T» is turned upwards.

As shown in FIG. 1, corresponding to a cross-section in a plane containing the axis X-X and passing through the indicator 20, the ribs respectively making up the indicators 20 and 21 protrude from the outer surface of the base 4 of the neck 2, in particular in a portion of that base 4 that is not covered by the skirt 12 of the stopper 10 when the packaging system is in its closed configuration. Thus, in the closed configuration of the packaging system, the indicators 20 and 21 borne by the neck 2 are visible from the outside of the packaging system, protruding from the outer surface of the base 4 of the neck 2. Examples of manufacturing of the ribs respectively making up the indicators 20 and 21 will be outlined below, in particular in light of FIGS. 4 to 7.

Also according to the invention and as shown in FIGS. 1 and 2, the skirt 12 of the stopper 10 securely bears an indicator 22 in the form of a rib that protrudes from the outer surface of the skirt and that assumes an elongate shape extending in the direction of the axis of the stopper 10, in other words in the direction of the axis X-X when the packaging system is in its closed configuration. In the embodiment considered in FIGS. 1 to 3, the rib making up the indicator 22 is situated in the lower skirt portion 14, more specifically adjacent to the lower end edge of that skirt portion 14, having noted that, for reasons that will appear just below, the lower end edge constitutes an indicator, referenced 23.

According to the invention, when the packaging system is in its closed configuration, the ribs respectively making up the indicator 20 borne by the neck 2 and the indicator 22 borne by the skirt 12 extend lengthwise, aligned with each other, in the direction of the axis X-X. It will be understood that obtaining this alignment between the indicators 20 and 22 results from a suitable design of the packaging system 1, i.e. a suitable design regarding the angular position between the stopper 10 and the neck 2 in the sense that, in light of the screwing engagement between the skirt 12 and the ring 3, the tightening of the skirt 12 around the ring 3 under a pre-established screwing torque leads the skirt 12 to occupy a predetermined angular position, around the axis X-X, around the ring 3. Thus, by visually checking that the indicators 20 and 22 are aligned with each other when the packaging system is intended to be in its closed configuration as defined above, it is possible to check quickly and easily that the stopper 10 has in fact been suitably screwed on the neck 2, as is also the case in FIGS. 1 and 2. Conversely, if the indicators 20 and 22 are not in the same angular position around the axis X-X at the end of the tightening operation of the stopper 10, intended to put the packaging system in the closed configuration thereof, this means that the screwing of the stopper has been done poorly, and irrespective of the reason, since the skirt 12 is then not, around the ring 3, in the angular position it is intended to occupy if that screwing had been done correctly.

Of course, in practice, the axial alignment between the indicators 20 and 22 advantageously takes a predetermined positioning allowance into account.

More generally, the invention also covers the alternative, not shown, according to which, rather than having designed the indicating elements 20 and 22 so that they are aligned with each other when the packaging system 1 is in the closed configuration, these elements are provided so as to be found angularly spaced apart around the X-X axis, from each other with a predetermined angular spacing value to within a tolerance. This alternative is of interest in the case when, for various reasons, notably related to unexpected drifts for making the stopper and/or the neck, as well as to the presence in the bottom of the stopper, of a seal element having a modified shape relatively to the intended one, the predetermined final position of the stopper, after satisfactorily placing the latter, in order to have the packaging system pass into the closed configuration, is characterized by an angular shift between the indicators 20 and 22 depending on the aforementioned spacing value. In practice, in order to determine this value, preliminary sampling of stoppers and containers from homogeneous batches is carried out and, while quantifying the applied tightening torque, they are put into a configuration in which the sealed obturating of the neck by the stopper is satisfactory: this configuration is then considered as the closed configuration of the packaging system, intended to be attained by applying a preset tightening torque, except in the case of malfunction of this system.

Furthermore, an option that is not shown consists of providing graduations on the skirt 12, on either side of the indicator 22, or else on the ring 3, on either side of the indicator 20, making it possible to quantify the angular gap around the axis X-X between the indicators 20 and 22 when those indicators 20 and 22 are not aligned and, from there, either to check whether this spacing has the aforementioned predetermined value when the latter is non-zero, which expresses proper screwing of the stopper on the neck, or to quantify the actual positioning gap of the stopper 10 in relation to the position it should have reached if its screwing had been done correctly to arrive at the closed configuration of the packaging system. In practice, it is understood that these graduations are distributed along the periphery of the skirt, of the ring of the neck, respectively, with a predetermined pitch, such that by counting the number of those graduations angularly present between the indicators 20 and 22, it is possible to deduce an angle value for the aforementioned angular gap to within a tolerance. Of course, the shape of these graduations is not limited to a shape similar to those of the indicators 20 and 22: for example, these graduations consist of furrows.

Furthermore, as shown in FIGS. 1 and 2, when the packaging system is in its closed configuration, the indicator 21 borne by the neck 2 extends parallel to the indicator 23 made up of the lower end edge of the skirt 12, with the insertion between these indicators 21 and 23 of an axial gap, denoted A in FIGS. 1 and 2. In other words, the aforementioned gap Δ corresponds to the distance, in the direction of the axis X-X, separating the indicators 21 and 23 from each other. It will be understood that, through a suitable design of the packaging system 1, the fact that this gap Δ is below a predetermined value means that, in the closed configuration of the packaging system, the stopper 10 occupies a satisfactory axial position along the neck 2, inasmuch as, at the end of placement of the stopper 10 around the neck 2, the skirt 11 has been lowered along the neck 2 low enough to bring the bottom wall 11 against the upper end of the ring 3, if required by sufficiently axially crushing the sealing disc 13. Conversely, in the case where the indicators 21 and 23 are axially too far from each other at the end of placement of the stopper 10 on the neck 2, in other words if their relative axial spacing is above the predetermined value Δ, that would mean that, for any given reason, the stopper 10 was not downwardly engaged enough around the ring 3 for the packaging system to effectively reach its closed configuration as defined above. Thus, by visually checking the parallelism and spacing between the indicators 21 and 23, one verifies the proper positioning, along the axis X-X, between the stopper 10 and the neck 2 when the packaging system is meant to be in its closed configuration.

For example, the gap Δ assumes a value in the vicinity of 1 mm, with the understanding that the chosen value is accompanied by an allowance margin.

In practice, the two visual checks explained above, respectively related to the pair of indicators 20 and 22 and the pair of indicators 21 and 23, are done at the end and independently of the bottling operation of the container 1, typically along an automated bottling line. These checks can be done either by a human operator, stationed along that line, or by dedicated image acquisition and processing means, such as a camera whereof the video output is processed by ad hoc software.

Of course, the order in which the two aforementioned visual checks are done is unimportant.

Furthermore, in light of the preceding explanations, it will be understood that the T shape of the indicators 20 and 21 considered jointly makes it possible, inter alia, to improve the visual effect produced by those indicators inasmuch as, on the one hand, thus being adjacent, the position of these indicators 20 and 21 can be assessed, in relation to the indicators 22 and 23, which are also advantageously adjacent, by observing a same area of the packaging system 1 and, on the other hand, the opposite ends of the indicator 21 can be taken into account to improve the assessment of the angular spacing value, notably their axial alignment in the case when this value is zero, between the indicators 20 and 22 whereas, at the same time, the longitudinal dimension of the indicator 20 can be used to facilitate the assessment of the value of the axial spacing between the indicators 21 and 23.

Hereafter, we will look more specifically at how the indicators 20 to 23 can be made.

It will be understood that the indicators 22 and 23, borne by the stopper 10, are easy to obtain during the manufacture of the stopper 10, in particular by molding a plastic material making up the skirt 12: the mold for molding that skirt is provided, on the one hand, with a mold cavity for the rib making up the indicator 22, that mold cavity occupying an angular position, around the axis X-X, that is predetermined as a function of the mold cavity of the thread 16, and, on the other hand, with the pre-established axial dimensioning in relation to the relative positioning between the lower end edge of the skirt 12, making up the indicator 23, and the upper end of the skirt 12 at which the bottom wall 11 extends.

Figure 4:
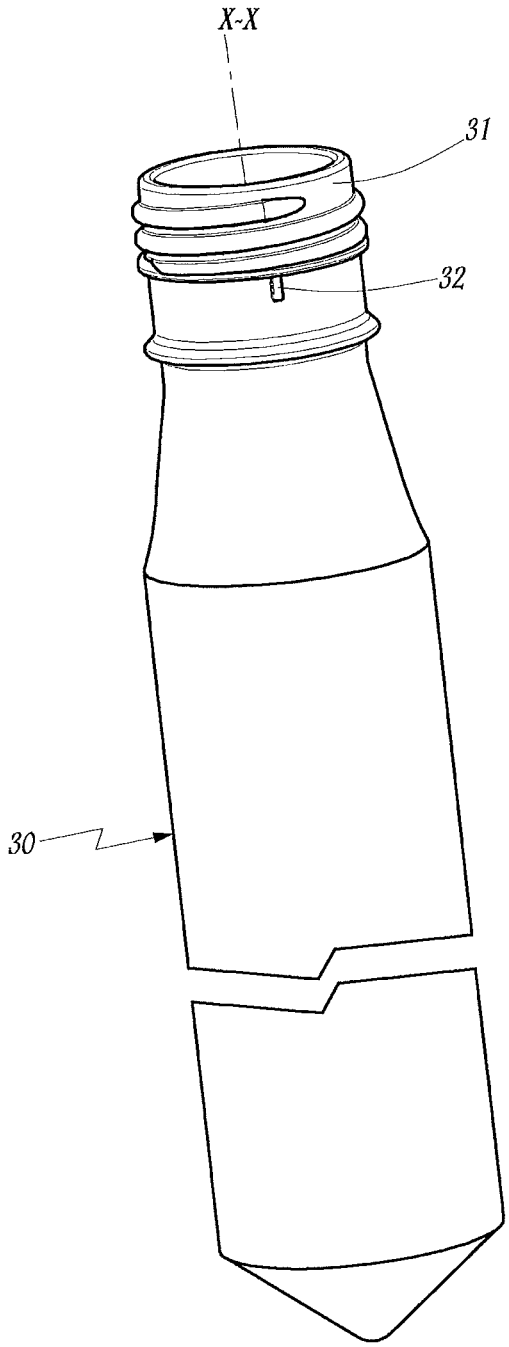
FIG. 4 is a perspective view of a preform from which a container of the packaging system according to the invention can be made.

Regarding the indicators 20 and 21 borne by the neck 2, one solution consists of obtaining the ribs that make up those indicators 20 and 21 jointly with the shaping of the container 1, in particular jointly with the blowing of the container 1 from a preform, such as the preform 30 shown in FIG. 4. It will be understood that, to obtain a predetermined positioning of the indicators 20 and 21 in relation to the rest of the neck 2, one must ensure proper positioning of the mold in which the preform 30 is placed to blow it. In this way, the axial position of the preform 30 in the aforementioned blowing mold is checked to obtain the appropriate axial positioning of the indicator 21, typically by checking the axial altitude of the threaded ring 31 of the preform 30 in a complementary tapped receiving area, securely connected to the blowing mold.

Likewise, the angular position, around the axis X-X, of the ring 31 in relation to the blowing mold needs to be checked. To that end, it is provided to be able to identify the angular position of the ring 31 around the blowing mold in which the preform 30 is placed. In the embodiment considered in FIG. 4, this angular positioning is identified by a rib 32, which is borne protruding from the outer surface of the ring 31 and which extends lengthwise along the direction of the axis X-X, occupying an angular position, around the axis X-X, that is predetermined in relation to the rest of the ring 31, in particular in regard to its thread. In this way, when the ring 31 is screwed in the tapped receiving area, securely connected to the blowing mold, the rib 32 is used to angularly index the preform 30, for example by abutting against an ad hoc region of the tapped receiving area.

Figure 7:
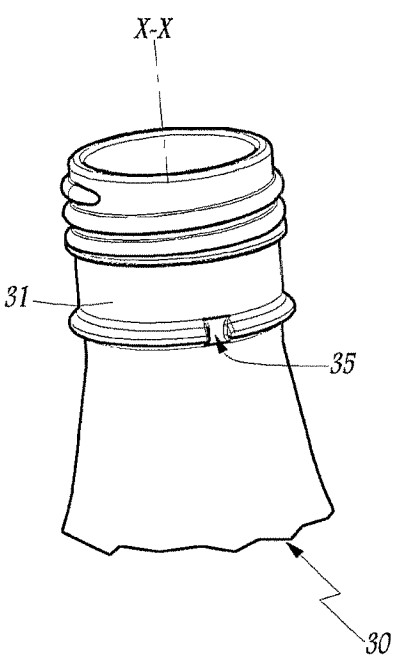
FIGS. 5 to 7 are views similar to FIG. 4, illustrating various alternative embodiments of the preform.
Figure 6:
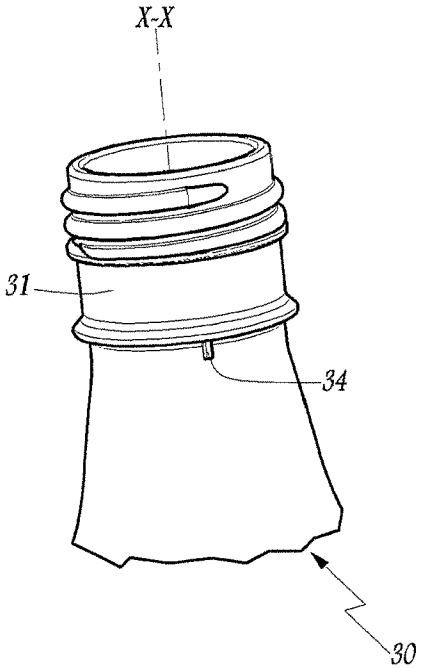
Figure 5:
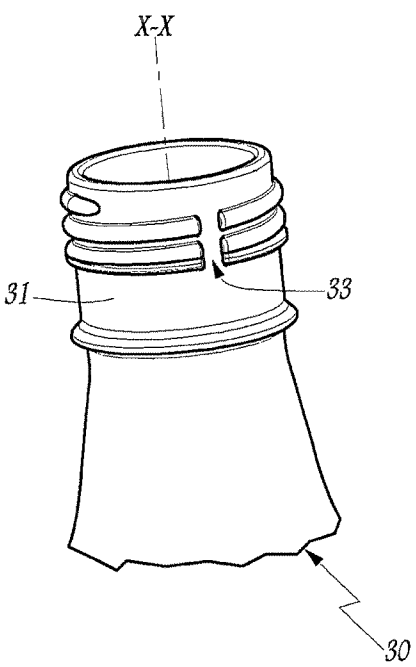

Of course, the rib 32 described above is only one possible example of an embodiment for angularly indexing the preform 30 around the axis X-X, so as to check its angular positioning in relation to the mold in which that preform is placed, then blown to obtain the container 1. As an example, FIGS. 5 to 7 show three possible alternatives of the indexing means, functionally similar to the rib 32:

- in the alternative of FIG. 5, the thread of the ring 31 has a material interruption, referenced 33, in a predetermined angular portion of the ring;
- in the alternative of FIG. 6, the rib 32 is replaced by a rib 34 which, unlike the rib 32 situated axially just below the thread of the ring 31, is situated axially just below a peripheral seal corresponding to the heel 6 for the neck 2 of the container 1; and
- in the alternative of FIG. 7, the aforementioned peripheral heel of the ring 31 is not associated with a rib similar to the rib 34, but has a material interruption, referenced 35, in a predetermined peripheral portion.

Various arrangements and alternatives of the packaging system 1 described thus far, as well as its manufacturing method, can also be considered. For example:

- rather than making the referencing elements 20 and 21 and/or the referencing elements 22 and 23 in the form of raised portions obtained jointly with the shaping of the container 1, at least some of these elements can be obtained after shaping of the container 1, by being made in the form of an attached mark made on the neck 2; such an attached mark can in particular be made by laser marking or ink marking; of course, the production of this attached mark must be done such that the indicator formed by that mark is suitably positioned, axially and/or angularly, on the neck 2 and/or on the stopper 10 to allow, as explained above, visual checking of the closed configuration of the packaging system;
- likewise, regarding the indicators 20 and 21, rather than making them during shaping of the container 1 from the preform 30, in particular using the blowing mold described above, one or the other of these elements 20 and 21 can be made during the manufacturing of the preform itself, in particular during the injection of that preform; in that case, the indicator, provided when the preform is manufactured, is positioned on the preform in a predetermined manner in relation to the ring 31, to guarantee, after blowing of the container 1, the subsequent implementation of relative positioning checks of the stopper 10 and the neck 2 when the packaging system is in the closed configuration; of course, the pre-positioning of this or these indicator(s) on the preform should not be altered during the subsequent blowing of the preform to obtain the container 1;

rather than using the lower end edge of the skirt 12 to make up the indicator 23, the latter can be made by a raised portion or a specific mark, separate from the lower edge; this situation nevertheless moves that dedicated raised portion or that dedicated mark, in direction X-X, further away from the indicator 21 borne by the neck 2;

irrespective of how the indicators 20, 21, 22 and 23 are made, those elements may have contours other than straight lines; thus, as alternatives not shown, one or more of them have a contour in the shape of an arrow, a ball, a triangle, etc.;

rather than including a non-removable portion, like the lower skirt portion 14 for the skirt 12, the skirt of the stopper 10 can be made in a single piece, without including a weakening line similar to the line 19; in that case, when the packaging system is opened, that skirt is completely freed with regard to the neck 2; and/or it is understood that, in the case where the ring 3 and the skirt 12 have several threads, for example two or three threads, but are engaged during screwing of the skirt 12 around the ring 3, the skirt 12 outwardly bears the same number of indicators 22 and/or the neck 2 has the same number of indicators 20, so as to visually check the angular position of the stopper 10 in relation to the neck 2 when the packaging system is in its closed configuration.

The invention claimed is:

1. A packaging system, comprising:

a container (1), which includes a neck (2) defining an axis (X-X), and a stopper (10) for closing the neck, which includes a skirt (12) provided with first threading means (16) for removable fastening around the neck, adapted to cooperate by screwing around said axis (X-X) with second threading means (5) borne by the neck so as, by applying a preset stress for having the first threading means cooperate with the second threading means, to have the packaging system pass from an open configuration, in which the stopper is at least partially freed from the neck to open the neck on the outside of the container, to a closed configuration, in which the skirt occupies at least one predetermined position on the neck in which the stopper seals the neck, wherein the packaging system includes checking means (20, 21, 22, 23) for visually checking that the packaging system is in said closed configuration after applying said preset stress, said checking means comprise both:

a first neck indicator (20) on the neck (2) and a first skirt indicator (22) on the skirt (12), the first neck indicator (20) and first skirt indicator (22) indicating the angular position around the axis (X-X) between the neck (2) and the skirt (12), said first neck indicator (20) and first skirt indicator (22) being designed to be arranged with an angular spacing between them which is smaller than or equal to a first predetermined value when the packaging system is in said closed configuration, and a second neck indicator (21) on the neck (2) and a second skirt indicator (23) on the skirt (12), the second neck indicator (21) and second skirt indicator (23) indicating the position along the axis (X-X) between the neck (2) and the skirt (12), said second neck indicator (21) and second skirt indicator (23) being separated from the first neck indicator (20) and first skirt indicator (22), borne respectively by the neck and by the skirt, and designed to be arranged parallel to each other with an axial spacing (Δ) between them which is below a second predetermined value, when the packaging system is in said closed configuration, wherein the stopper is open at its lower end and closed at its upper end by a bottom wall, the packaging system further comprising a sealing disc covering the bottom wall, the second neck indicator (21, 23) and the second skirt indicator being further designed to be arranged parallel to each other with the axial spacing (Δ) between them which is below the second predetermined value, when the sealing disc is sufficiently axially crushed by the neck.

2. The packaging system according to claim 1 wherein the first neck indicator (20) and/or the second neck indicator (21), borne by the neck (2), are provided on the outer surface of part (4) of the neck, not covered by the stopper (10) when the packaging system is in said closed configuration.

3. The packaging system according to claim 1, wherein the first indicator skirt (22) and/or the second skirt indicator (23), borne by the skirt (12), are provided on the outer surface of the end portion of the skirt (12), oriented opposite the free end of the neck (2) when the packaging system is in said closed configuration.

4. The packaging system according to claim 1, wherein the second skirt indicator (23) borne by the skirt (12) is made up of at least one portion of the end edge of the skirt, oriented opposite the free end of the neck (2) when the packaging system is in said closed configuration.

5. The packaging system according to claim 1, wherein each of the first neck indicator (20) and first skirt indicator (22) has an elongate shape that extends parallel to the axis (X-X).

6. The packaging system according to claim 1, wherein each of the second neck indicator (21) and second skirt indicator (23) has an elongate shape that extends orthoradial to the axis (X-X).

7. The packaging system according to claim 1, wherein the first neck indicator (20) and the second neck indicator (21), borne by the neck (2), are substantially adjacent to one another, and the first skirt indicator (22) and the second skirt indicator (23), borne by the skirt (12), are substantially adjacent to one another.

8. The packaging system according to claim 7, wherein the first neck indicator (20) and the second neck indicator (21), borne by the neck (2), have a T-shaped joint contour.

9. The packaging system according to claim 8, wherein said T-shaped contour is such that its vertical line extends parallel to the axis (X-X) and is horizontal line is turned towards the free end of the neck (2).

10. The packaging system according to claim 1, wherein the skirt (12), or the neck (2), also bears graduations, which are distributed, along the periphery of the skirt, of the neck, respectively, on either side of the first neck indicator (20) or first skirt indicator (22).

11. The packaging system according to claim 1, wherein the first neck indicator (20) and/or the second neck indicator (21), borne by the neck (2), are made up of raised portions obtained jointly by shaping, in particular blowing, the container (1) from a preform (30) that includes an angular indexing means (32; 33; 34; 35) around the axis (X-X), adapted to identify the positioning of said raised portions on the neck when the container is shaped.

12. The packaging system according claim 1, wherein the first neck indicator (20) and/or the second neck indicator (21), borne by the neck (2), are made during the manufacture of a preform (30) from which the container (1) is manufactured, while being positioned on that preform in a predetermined manner.

13. The packaging system according to claim 1, wherein the first neck indicator (20) and/or the second neck indicator (21), borne by the neck (2), are made up of marks made on the neck after shaping of the container (1), said marks made by laser marking or ink marking.

14. The packaging system according to claim 1, wherein the first fastening means comprise a thread (16) and the second threading means comprise a thread (5) which mates the thread of the first threading means, both of these threads cooperating by screwing around the axis (X-X), and thus having the packaging system pass from its open configuration to its closed configuration, by applying a preset tightening torque.

15. A method of packaging, comprising:

providing a packaging system (1) according to claim 1, wherein:

the packaging system is available in its open configuration, and then the first threading means (16) are caused to cooperate with the second threading means (5) under the preset stress, notably by screwing them with a preset tightening torque, and then visually checking the packaging system is in its closed configuration, by checking that the first neck indicator (20) and first skirt indicator (22) are angularly spaced out from each other, around the axis (X-X) by the first predetermined value on the one hand, and by checking that the second neck indicator (21) and second skirt indicator (23) are spaced out from each other along the axis (X-X) by less than the second predetermined value.

16. The packaging system according to claim 1 wherein:

the first neck indicator (20) includes a vertical line segment on the neck, the first skirt indicator (22) includes a vertical line segment on the skirt, the second neck indicator (21) includes a horizontal line segment on the neck, the second skirt indicator (23) includes a lower end edge of the skirt.

17. The packaging system according to claim 16, wherein the first neck indicator (20) and the second neck indicator (21) intersect to form a T-shape.

18. The packaging system according to claim 16, wherein the neck has an opening at an end of the container, and the horizontal line segment on the neck is between the opening and the vertical line segment on the neck.

19. The packaging system according to claim 1, wherein the first neck indicator and the second neck indicator are respectively in the form of an elongated rib that protrudes from the outer surface of the skirt that extends in a direction of the axis (X-X) and in a direction orthoradial to the axis (X-X), the first skirt indicator being in the form of a rib that protrudes from the outer surface of the skirt that extends in a direction of the axis (X-X) when the packaging system is in its closed configuration, the second skirt indicator being made up of at least one portion of the end edge of the skirt, oriented opposite the free end of the neck when the packaging system is in said closed configuration.

* * * * *